US010595111B2

(12) United States Patent
Ring et al.

(10) Patent No.: US 10,595,111 B2
(45) Date of Patent: Mar. 17, 2020

(54) EARBUD FRAME FOR ACOUSTIC DRIVER AND COMPLIMENTARY EAR TIP

(71) Applicant: Bose Corporation, Framingham, MA (US)

(72) Inventors: Martin D. Ring, Ashland, MA (US); Michael Andrew Zalisk, Arlington, MA (US); Mark R. Bergeron, Grafton, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 15/463,797

(22) Filed: Mar. 20, 2017

(65) Prior Publication Data

US 2018/0270558 A1 Sep. 20, 2018

(51) Int. Cl.

| | |
|---|---|
| ***H04R 1/10*** | (2006.01) |
| ***H04R 1/02*** | (2006.01) |
| ***H04R 9/02*** | (2006.01) |

(52) U.S. Cl.

CPC ..... *H04R 1/1016* (2013.01); *H04R 1/02* (2013.01); *H04R 1/023* (2013.01); *H04R 1/10* (2013.01); *H04R 1/1075* (2013.01); *H04R 1/1091* (2013.01); *H04R 9/025* (2013.01); *H04R 2460/11* (2013.01)

(58) Field of Classification Search

CPC ..... H04R 1/023; H04R 9/025; H04R 1/1075; H04R 1/1091; H04R 2460/11

USPC ..... 381/380, 375

See application file for complete search history.

(56) References Cited

U.S. PATENT DOCUMENTS

| | | | | |
|---|---|---|---|---|
| 2,482,148 | A | 9/1949 | Beckman et al. | |
| 4,327,257 | A | 4/1982 | Schwartz | |
| 7,916,888 | B2 | 3/2011 | Sapiejewski et al. | |
| 8,594,351 | B2 | 11/2013 | Harlow et al. | |
| 8,699,744 | B2 | 4/2014 | Sakaguchi et al. | |
| 9,036,853 | B2 | 5/2015 | Silvestri et al. | |
| 9,094,750 | B2 | 7/2015 | Fujise et al. | |
| 2009/0041285 | A1* | 2/2009 | Parkins | A61F 11/08 381/372 |
| 2009/0074222 | A1* | 3/2009 | Song | H04R 19/016 381/357 |
| 2009/0161885 | A1* | 6/2009 | Donaldson | H04R 1/1083 381/71.6 |
| 2009/0321176 | A1* | 12/2009 | Cartwright | A61F 11/008 181/131 |
| 2011/0051981 | A1 | 3/2011 | Lehdorfer et al. | |

(Continued)

FOREIGN PATENT DOCUMENTS

| | | | |
|---|---|---|---|
| CN | 201222797 | Y | 4/2009 |
| WO | 2007005221 | A1 | 1/2007 |

OTHER PUBLICATIONS

"HD 580 Dynamic Headphone, Product Specifications", Sennheiser Electronic Corporation, Old Lyme, CT.

(Continued)

*Primary Examiner* — Curtis A Kuntz
*Assistant Examiner* — Julie X Dang
(74) *Attorney, Agent, or Firm* — Schmeiser, Olsen & Watts LLP; V. Raman Bharatula

(57) ABSTRACT

An earbud may include an acoustic driver. The acoustic driver may include a diaphragm and a magnetic circuit. A frame of the acoustic driver may be integrated with the earbud.

26 Claims, 9 Drawing Sheets

(56) References Cited

U.S. PATENT DOCUMENTS

2011/0058704 A1* 3/2011 Harlow ..... H04R 1/1016 381/380
2011/0103610 A1* 5/2011 Harsch ..... H04R 1/1016 381/74
2012/0128192 A1* 5/2012 Burgett ..... H04R 1/1016 381/380
2012/0163648 A1* 6/2012 Cardas ..... H04R 1/1016 381/380
2012/0237074 A1 9/2012 Aase
2013/0259286 A1* 10/2013 Chung ..... H04R 1/1016 381/380
2013/0315410 A1* 11/2013 Annunziato ..... H04R 1/1083 381/71.6
2013/0315412 A1* 11/2013 Annunziato ..... G10K 11/16 381/71.6
2014/0056455 A1* 2/2014 Sakaguchi ..... H04R 1/2811 381/328
2014/0064548 A1* 3/2014 Chu ..... H04R 1/1091 381/380
2014/0079274 A1 3/2014 Monahan et al.
2014/0140565 A1 5/2014 Liu
2014/0205125 A1* 7/2014 Triato ..... H04R 1/105 381/330
2015/0071477 A1* 3/2015 Mainini ..... H04R 1/105 381/380
2015/0181341 A1 6/2015 Azmi
2015/0264467 A1* 9/2015 Annunziato ..... H04R 1/1058 381/380
2016/0261942 A1* 9/2016 Hayden ..... H04R 1/105
2016/0261944 A1* 9/2016 Silvestri ..... H04R 1/2826
2018/0035196 A1* 2/2018 Yeung ..... H04R 1/1025

OTHER PUBLICATIONS

Hertsens, Tyll "The Very Important Sennheiser HD 580, HD 600, and HD 650," InnerFidelity.com, Mar. 13, 2013; 15 pages.
InnerFidelity, "Dissasembly, Spring Repair, and Reassembly of the Sennheiser HD 580, HD 600, and HD650," Source Interlink Media, YouTube.com, Mar. 13, 2013.
International Search Report and Written Opinion in International Patent Application No. PCT/US18/22601 dated Jul. 13, 2018; 15 pages.
International Preliminary Report on Patentability in PCT/US2018/022601 dated Oct. 3, 2019; 9 pages.

* cited by examiner

EARBUD FRAME FOR ACOUSTIC DRIVER AND COMPLIMENTARY EAR TIP

BACKGROUND

This disclosure relates to an earbud frame for an acoustic driver and more specifically to an acoustic driver with a frame integrated with an earbud.

SUMMARY

All examples and features mentioned below can be combined in any technically possible way.

In an implementation, an in-ear earphone may include an earbud. The earbud may include an acoustic driver. The acoustic driver may include a diaphragm and a magnetic circuit. A frame of the acoustic driver may be integrated with the earbud.

Various implementations of the in-ear earphone may include one of the following features, or any combination thereof.

The acoustic driver may be framed directly by the earbud. The acoustic driver may be embedded in the earbud. The acoustic driver may have no frame separate from the earbud. A front cavity enclosure may form an outlet and a first port from the acoustic driver to an outside of the earbud. An ear tip may surround at least the front cavity enclosure. The ear tip may have a second port mated to the first port to form a pressure equalization port from the acoustic driver to an outside of the ear tip. The ear tip may include a first leg and a second leg.

A resistive mesh may be positioned over the first port. The in-ear earphone may include a microphone. The frame of the acoustic driver integrated with the earbud may maximize a size of the diaphragm of the acoustic driver relative to a size of the earbud. The second port of the ear tip may have a different length for a small tip ear tip than a medium tip ear tip. The earbud may further include a back cavity cap.

In an implementation, an earbud may include an acoustic driver. The acoustic driver may include a diaphragm and a magnetic circuit. A frame of the acoustic driver may be integrated with the earbud.

Various implementations of the earbud may include one of the following features, or any combination thereof.

The acoustic driver may be framed directly by the earbud. The acoustic driver may be embedded in the earbud. The acoustic driver may have no frame separate from the earbud. A front cavity enclosure may form an outlet and a port from the acoustic driver to an outside of the earbud. The earbud may include a back cavity cap. The port may be a pressure equalization port from the acoustic driver to the outside of the earbud. A resistive mesh may be positioned over the port. The earbud may include microphone. The frame of the acoustic driver integrated with the earbud may maximize a size of a diaphragm of the acoustic driver relative to a size of the earbud.

In an implementation, an ear tip for an in-ear earphone may be formed from a pliable material to surround at least a front cavity enclosure of an earbud. The earbud may include an acoustic driver having a diaphragm and a magnetic circuit. The frame of the acoustic driver may be integrated with the earbud.

Various implementations of the ear tip may include one of the following features, or any combination thereof.

The ear tip may include a first leg, a second leg, and a first port positioned between the first leg and the second leg to mate with a second port of the front cavity enclosure of the earbud. The first port of the ear tip may have a different length for a small tip ear tip than a medium tip ear tip. The first port and the second port may mate to form a pressure equalization port from the acoustic driver to an outside of the ear tip.

In an implementation, an ear tip may include a positioning and retaining structure. The positioning and retaining structure may include a second port positioned to mate with a first port of a front cavity enclosure of an earbud. The first port may be multiple parallel ports. The second port may be multiple parallel ports.

DETAILED DESCRIPTION

Figure 1:
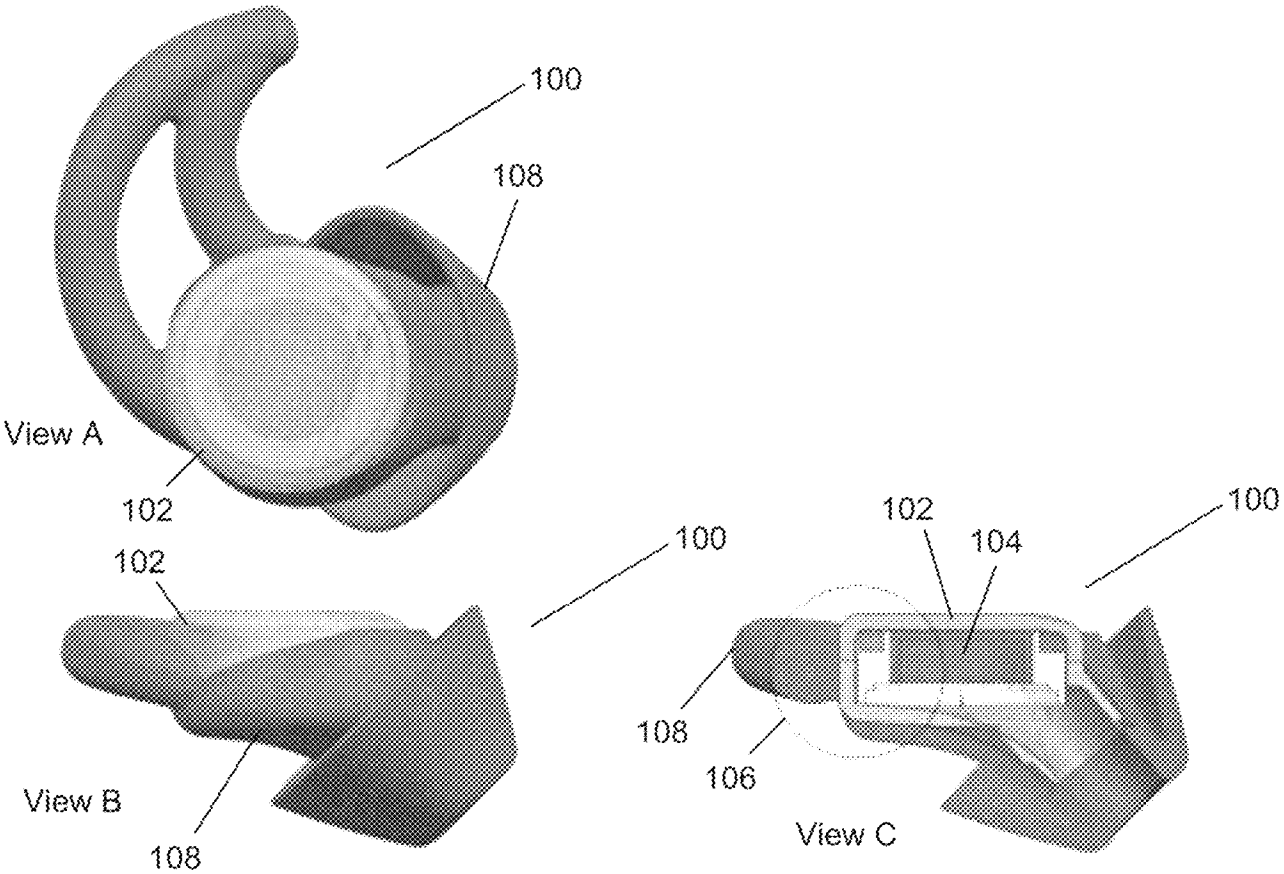
FIG. 1 shows various views of an in-ear earphone having an acoustic driver with a frame separate from an earbud, and a small ear tip.

A typical micro-speaker or acoustic driver for an earphone may include a basket, also called a frame, a diaphragm mounted to the frame, and a magnetic circuit (coil, magnet, etc.) that forces the diaphragm to move relative to the frame. A typical earphone may include an earbud having a housing, an acoustic driver, and an ear tip. The earbud housing may enclose all or almost the entire acoustic driver frame or basket, and may leave an outlet for coupling an acoustic driver output to an ear canal. Additional ports for shaping an acoustic response may be included.

As earbuds have decreased in size, the frame of the acoustic driver has become the largest single component of the earbud. As a result, the frame of the acoustic driver has limited the minimum size of the earbud. The present disclosure describes techniques and features for using the earbud itself as the frame for the acoustic driver such that a separate frame for the acoustic driver is not needed. In an implementation, the earbud may be designed such that the diaphragm and magnetics of the acoustic driver are built directly into the earbud enclosure. The acoustic driver or micro-speaker is no longer a stand-alone component, but rather part of the earbud itself.

The present teaching will now be described in more detail with reference to various implementations thereof as shown in the accompanying drawings. Reference in the specification to "one implementation" or "an implementation" means that a particular feature, structure or characteristic described in connection with the implementation may be included in at least one implementation of the present disclosure. References to a particular implementation within the specification do not necessarily all refer to the same implementation. While the present disclosure is described in conjunction with various implementations and examples, it is not intended that the present disclosure be limited to such implementations. On the contrary, the present disclosure encompasses various alternatives, modifications and equivalents, as will be appreciated by those of skill in the art. Those of ordinary skill having access to the present disclosure will recognize additional implementations, modifications and embodiments, as well as other fields of use, which are within the scope of the present disclosure as described herein.

In brief overview, the present disclosure relates to an earbud, an ear tip, and an in-ear earphone. The earbud may include an acoustic driver, which may include a diaphragm and a magnetic circuit. A frame of the acoustic driver may be integrated with the earbud. The acoustic driver may be framed directly by the earbud and/or embedded in the earbud. Further, the acoustic driver may have no frame separate from the earbud. In an implementation, a front cavity enclosure may form an outlet and a port from the acoustic driver to an outside of the earbud. The earbud may also include a back cavity cap. The port may be a pressure equalization port from the acoustic driver to the outside of the earbud and a resistive mesh may be positioned over the port. The frame of the acoustic driver integrated with the earbud may maximize a size of the diaphragm of the acoustic driver relative to a size of the earbud.

In some situations, an earbud may have two walls because an acoustic driver of the earbud has its own frame, basket, or housing. Two separate walls of plastic may not be necessary because the acoustic device may not need its own frame, basket, or housing, as it is only holding a magnetic circuit and a diaphragm. In an implementation of the present disclosure, the ear bud itself may be a structure holding the magnetic circuit and diaphragm in place, eliminating the need for the acoustic driver to have a separate frame, basket, or housing. Thus, in an implementation, there is no need for the acoustic driver or transducer to have a separate packaging (frame, basket, and/or housing, etc.) inside the earbud. Eliminating this extra packaging may allow for the earbud package to be smaller such that it can fit smaller ears and/or protrudes less from a wearer's ear. In addition, the smaller earbud may enable use with smaller sized ear tips than could otherwise be used.

Advantageously, the earbud, ear tip, and in-ear earphone described in the present disclosure may allow for each of the earbud, ear tip, and in-ear earphone to be smaller in size than a typical earbud, ear tip, and/or in-ear earphone due to elimination of the need for a separate frame for an acoustic driver of the earbud. Using the techniques and features described in the present disclosure, a minimum earbud size for a given acoustic driver diaphragm size may be achieved. As a result, the entire package of the earbud may better fit into the concha of a smaller ear than previously possible, and will protrude less from the concha of any ear size, thus improving a user's experience in wearing the earphone.

Also advantageously, an orientation of an acoustic driver (having an integrated frame as described in the present disclosure) in the ear tip may be substantially parallel relative to a body of the ear tip and may thus reduce an amount that the earbud protrudes from an ear tip/concha (as shown, e.g., in FIGS. 1, 3A-3B, 5B, 6 and 7). For example, earbuds having acoustic drivers without integrated frames, or having separate frames for the acoustic driver, may stick out more from the ear tip/concha because the frame of the acoustic driver may prevent the acoustic driver from being oriented substantially parallel relative to the body of the ear tip. The extra size of the frame of the acoustic driver may cause the acoustic driver to be oriented at an angle relative to the body of the ear tip rather than substantially parallel to the body of the ear tip, and may thus increase a z-height of the earbud (i.e., a distance from a back cavity cap of the earbud to an outlet of a front cavity enclosure of the earbud). Using the techniques and features described in the present disclosure, the z-height may be minimized and allow for the acoustic driver (with integrated frame) to be oriented substantially parallel to the body of the ear tip such that the earbud protrudes less from the ear tip/concha.

Referring now to FIG. 1, in-ear earphone 100 is shown in Views A-C. Earphone 100 may include acoustic driver 104 inside earbud 102. Acoustic driver 104 may be a 10 mm acoustic driver, though other sized drivers may be used. Portion 106 of earphone 100 shown in View C shows that earbud 102 does not fit into ear tip 108, leading to a larger overall package size of the in-ear earphone 100. As shown in View C, earbud 102 with a 10 mm acoustic driver is too large to fit in ear tip 108, a problem that is exacerbated when using a relatively smaller sized ear tip (e.g., one with a smaller width that is intended to fit in a smaller sized concha).

Figure 2B:
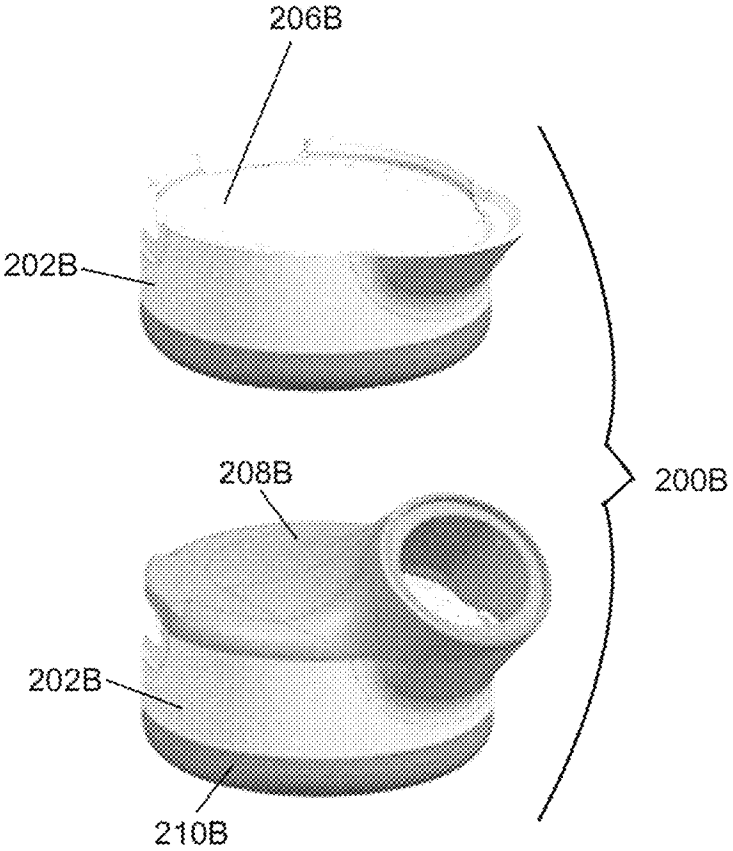
FIG. 2B shows various views of an earbud having an acoustic driver with a frame integrated with an earbud.
Figure 2A:
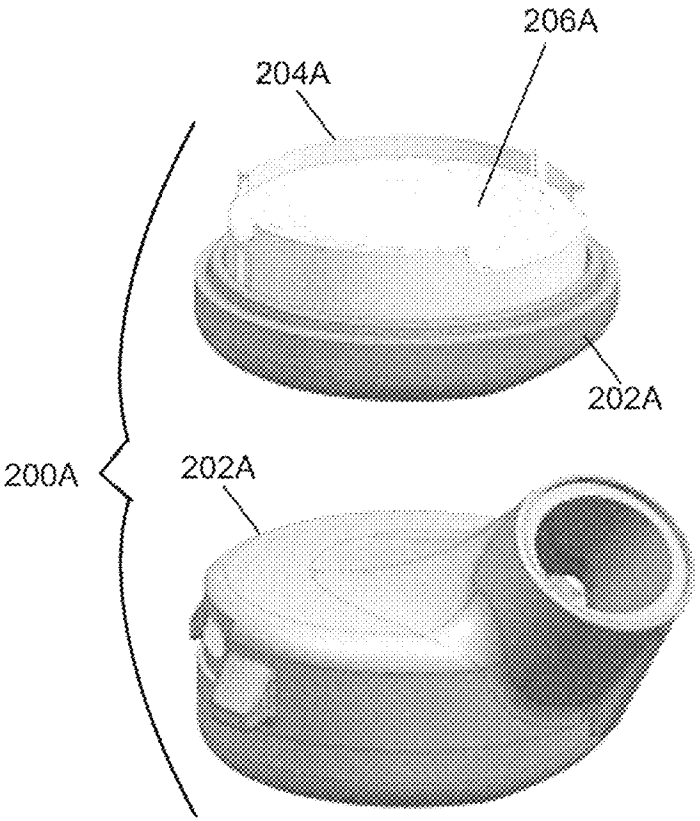
FIG. 2A shows various views of an earbud having an acoustic driver with a frame separate from an earbud.

Referring now to FIG. 2A, there is shown earbud assembly 200A where earbud 202A (which in this example includes a top and bottom portion) encloses acoustic driver frame 204A. Acoustic driver frame 204A frames diaphragm 206A and a magnetic circuit (not shown) and sits in earbud 202A. FIG. 2B shows earbud assembly 200B where earbud 202B houses diaphragm 206B and a magnetic circuit behind the diaphragm, not shown, but built directly into the frame of earbud 202B. Earbud assembly 200B no longer comprises a separate assembly that completely encloses the acoustic driver frame. As shown in FIG. 2B, a top (208B) and bottom (210B) portion of earbud 202B are coupled directly to the acoustic driver frame, thereby reducing the overall diameter of the earbud assembly 200B. Earbud assembly 200B may be significantly smaller than earbud assembly 200A because earbud assembly 200B lacks a separate earbud enclosure that surrounds the acoustic driver frame. Rather, the earbud 202B itself also functions as the frame for the acoustic driver. While FIG. 2B shows the earbud 202B as being made of several separate components or pieces, in some examples, the earbud 202B may be made of a single integral component.

Figure 3B:
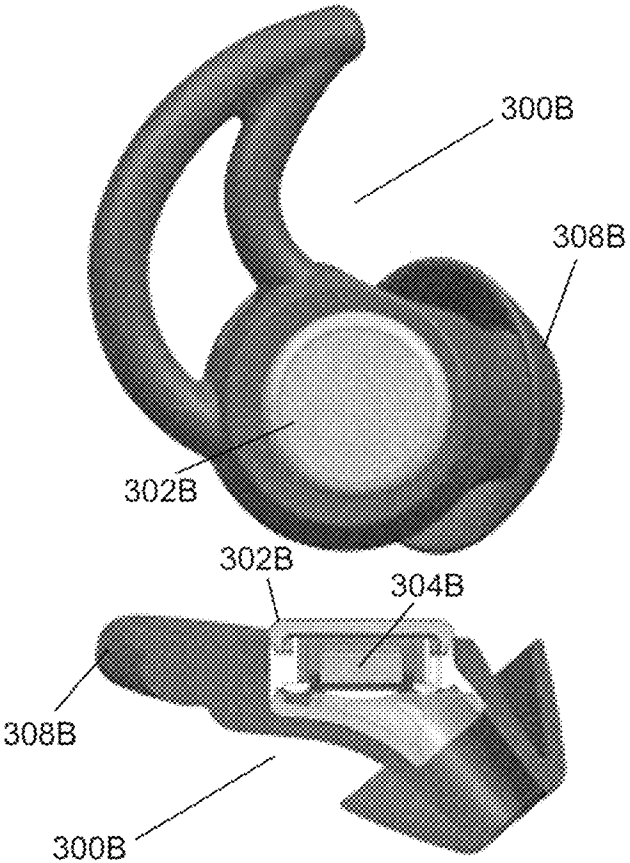
FIG. 3B shows various views of an in-ear earphone having an acoustic driver with a frame integrated with an earbud, and a medium ear tip.
Figure 3A:
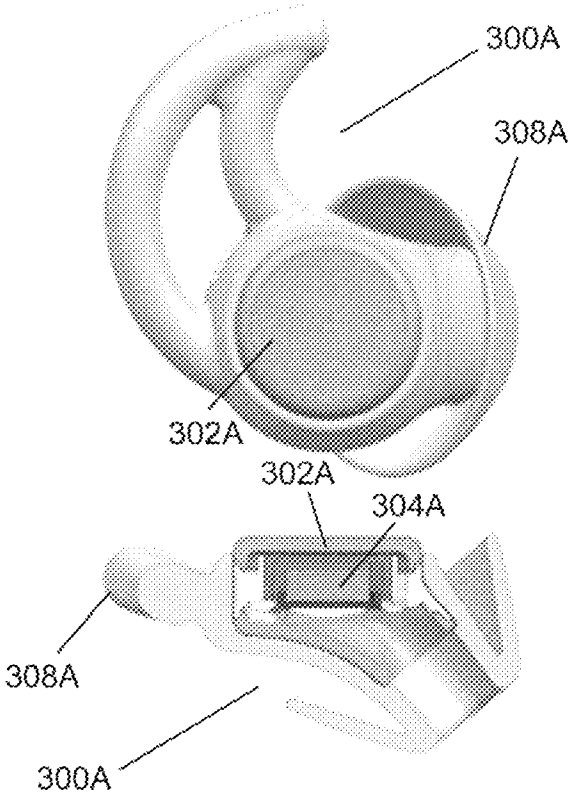
FIG. 3A shows various views of an in-ear earphone having an acoustic driver with a frame integrated with an earbud, and a small ear tip.

Referring now to FIGS. 3A and 3B, earphone 300A and earphone 300B are shown, respectively. In contrast to earphone 100 shown in FIG. 1 where earbud 102 does not fit into small ear tip 108, earbud 302A having acoustic driver 304A without an acoustic driver frame fits into a small-sized ear tip 308A of earphone 300A. Further, earbud 302B having acoustic driver 304B without an acoustic driver frame fits into a medium-sized ear tip 308B of earphone 300B. Acoustic driver 304A may sit directly in earbud 302A without an acoustic driver frame and acoustic driver 304B may sit directly in earbud 304B without an acoustic driver frame, thus allowing earbud 302A to be smaller in size and fit in small ear tip 308A and earbud 302B to be smaller in size and fit in medium ear tip 308B.

In an implementation, using the techniques and features described in the present disclosure to eliminate the need for an acoustic driver frame, a diameter of an earbud may be reduced by 1 mm-2 mm or more. This reduction in size of the earbud may allow for an in-ear earphone to have a larger diaphragm (of the acoustic driver) while still fitting in a smaller ear. For example, diaphragms of up to 11.8 mm or more for a medium ear tip and up to 10.2 mm or more for a small ear tip may be realized as a result of eliminating the acoustic driver frame. In addition, using a driver without an acoustic driver frame enables a design that protrudes less from a wearer's concha, thus improving stability of the earphone.

Figure 4A:
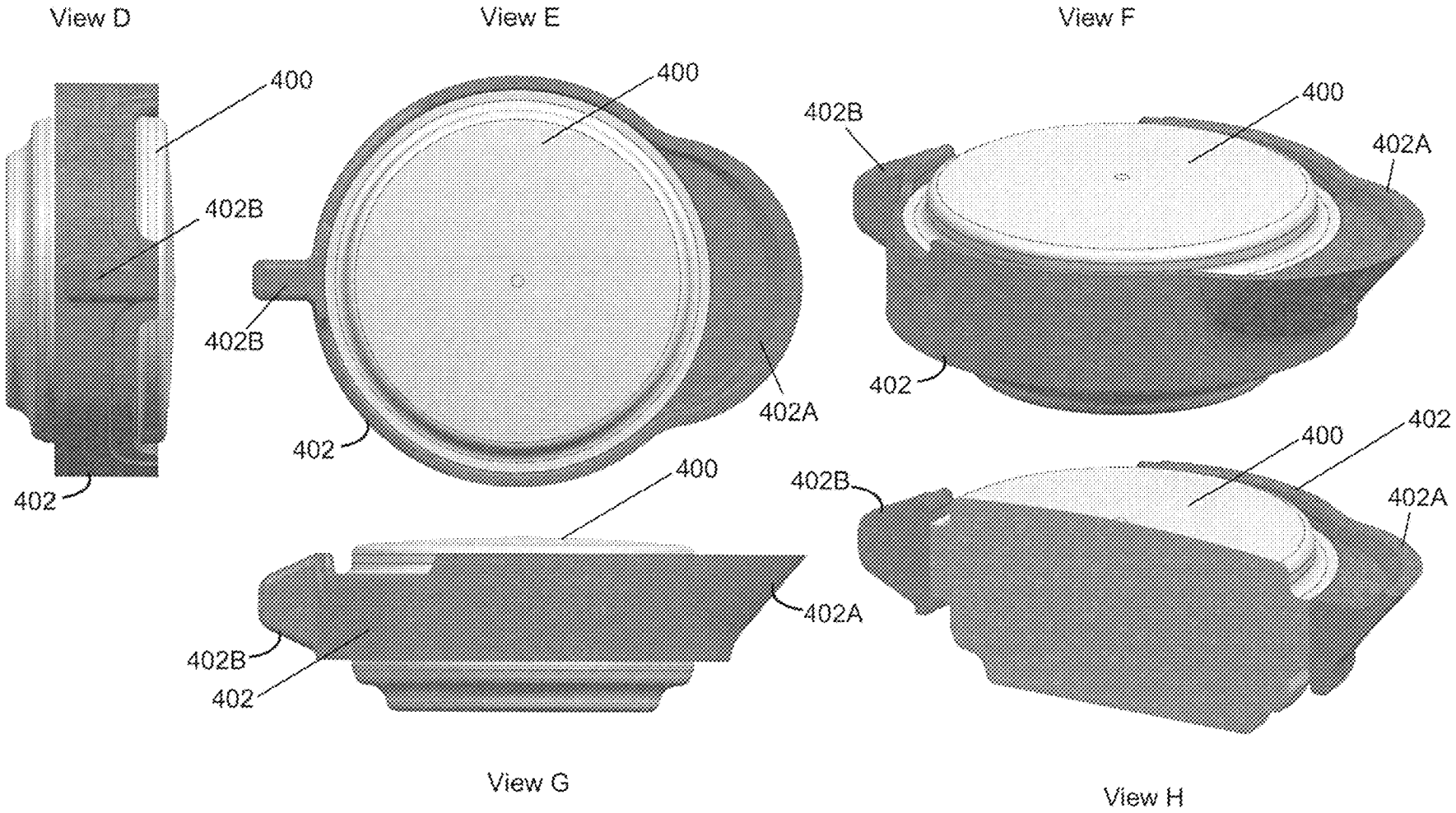
FIG. 4A shows various views of an acoustic driver with an integrated frame.

As discussed above, an in-ear earphone may include an earbud with an acoustic driver having a diaphragm and a magnetic circuit, and a frame of the acoustic driver may be integrated with the earbud. Referring now to FIG. 4A, various Views D-H of an acoustic driver 400 with an integrated frame 402 are shown. Integrated frame 402 may hold together a diaphragm and magnetic circuit of acoustic driver 400 and may be part of the earbud itself, rather than being a separate framing structure for acoustic driver 400. Integrated frame 402 may include a starting portion of a front cavity or nozzle (402A) and a hook or alignment portion (402B) to mate with an ear tip or cushion (not shown).

Figure 4B:
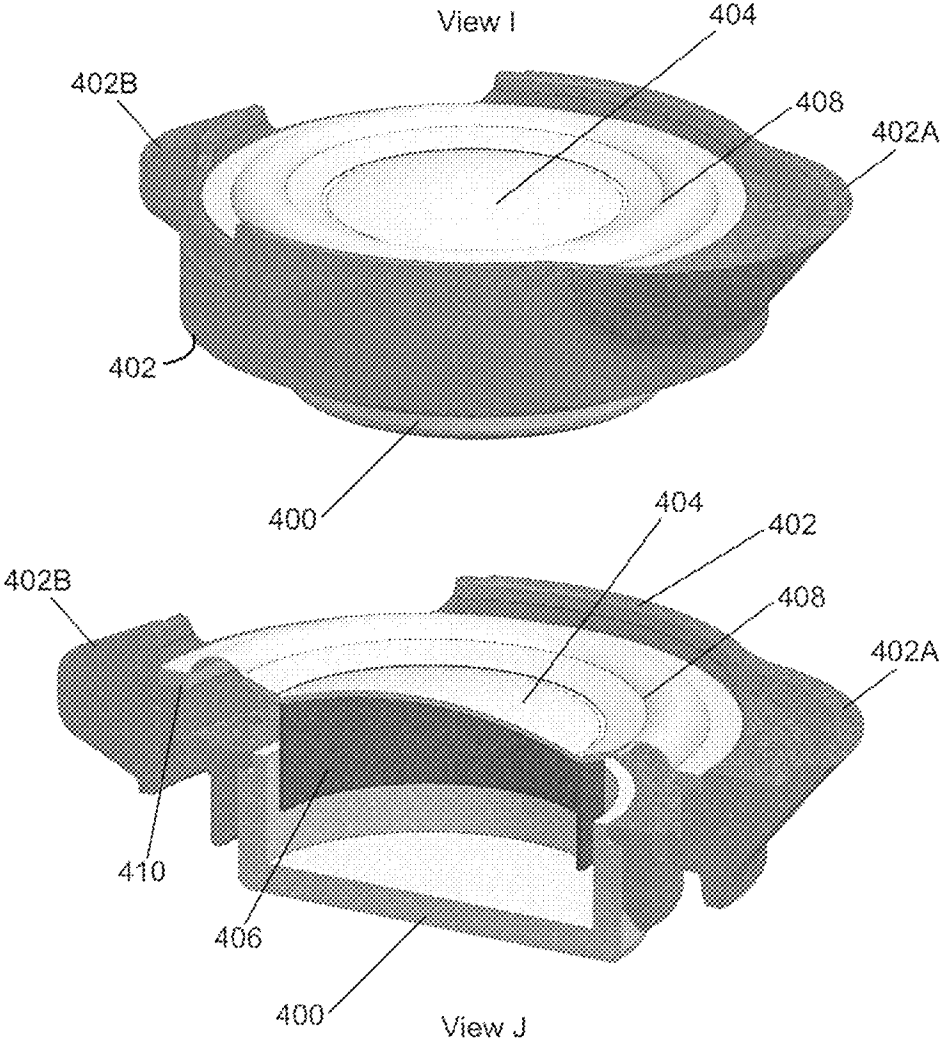
FIG. 4B shows various views of an acoustic driver with an integrated frame.

Referring now to FIG. 4B, further Views I and J of acoustic driver 400 with integrated frame 402 are shown. As shown in View J, acoustic driver 400 may include diaphragm 404 and voice coil 406. Voice coil 406 may be part of a magnetic circuit (not shown) of acoustic driver 400 or the magnetic circuit may be a separate component included in acoustic driver 400. As will be discussed below, integrated frame 402 may be part of an earbud assembly and the earbud itself. In an implementation, surround 408 and mounting ring 410 may also be included. Surround 408 may be a portion of the diaphragm that is elastic and may allow a central portion of the diaphragm to move while the outer portion is fixed to the frame, allowing for linear motion of voice coil 406 and the diaphragm, which may produce sound. Further, surround 408 may center voice coil 406 within a magnet. Mounting ring 410 (which may or may not be included), may help to form diaphragm 404 and may provide a reference point or datum for various fixtures of an earbud assembly. For example, mounting ring 410 may facilitate bonding voice coil 406, may help keep various components of the earbud centered, and may anchor surround 408 to integrated frame 402. It should be noted that acoustic driver 400 may include other components such as a magnet or other circuitry which are not shown in FIG. 4B.

Figure 5A:
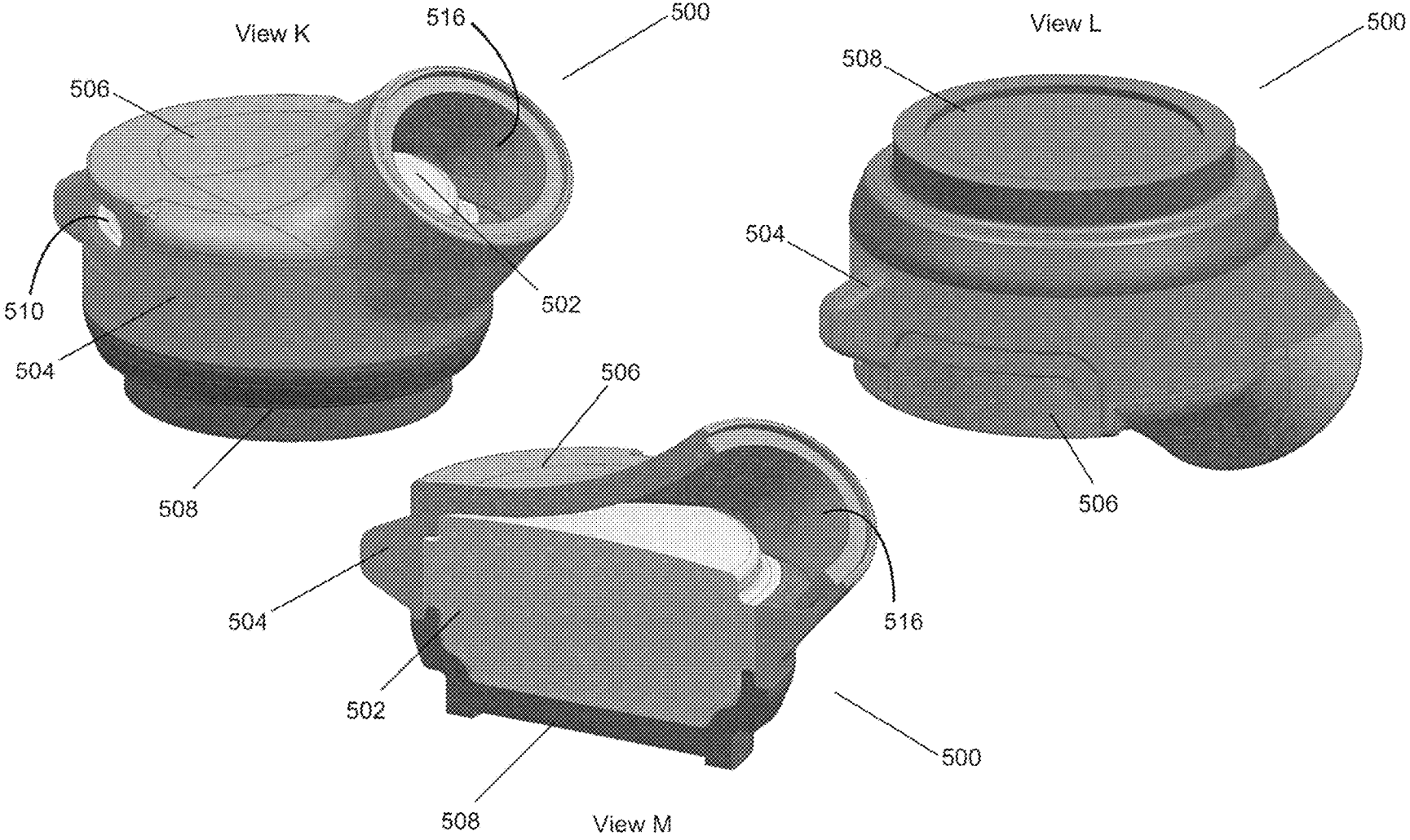
FIG. 5A shows various views of an acoustic driver having a frame integrated with an earbud.

Referring now to FIG. 5A, various Views K-M of an earbud assembly 500 are shown. Earbud assembly 500 may include acoustic driver 502 with integrated acoustic driver frame 504. In an implementation, acoustic driver 502 with integrated acoustic driver frame 504 may be joined with front cavity enclosure 506 and back cavity cap 508 to form earbud assembly or earbud 500. Integrated acoustic driver frame 504, front cavity enclosure 506, and back cavity cap 508 may be joined using a number of fabrication techniques, including but not limited to use of adhesives, welding, snaps, and/or molding. Front cavity enclosure 506 may form an outlet 516 and a port 510 from acoustic driver 502 to the outside of earbud 500. The integrated frame and front cavity enclosure components may be made of a number of materials including, but not limited to, elastomers, plastics, acrylonitrile butadiene styrene (ABS), polycarbonate, metals, and wood. The dimensions of these components may be variable but are generally small (e.g., 10 mm) such that the entire device may fit within a concha of the ear, with the front cavity opening directed towards an ear canal. A cushion/ear tip may acoustically and/or mechanically couple the front acoustic cavity to the ear canal.

As shown in Views K-M of FIG. 5A, acoustic driver 502 may be framed directly by earbud 500 and/or its components (e.g., integrated acoustic driver frame 504, front cavity enclosure 506, and/or back cavity cap 508). In this way, acoustic driver 502 may be embedded in earbud 500 and/or have no frame separate from earbud 500. Advantageously, one or more of integrated acoustic driver frame 504, front cavity enclosure 506, and/or back cavity cap 508 or a combination thereof, when joined to form earbud 500, may allow for maximization of the size of a diaphragm (e.g., diaphragm 404 of FIG. 4B) of acoustic driver 502 relative to the size of earbud 500.

Figure 5B:
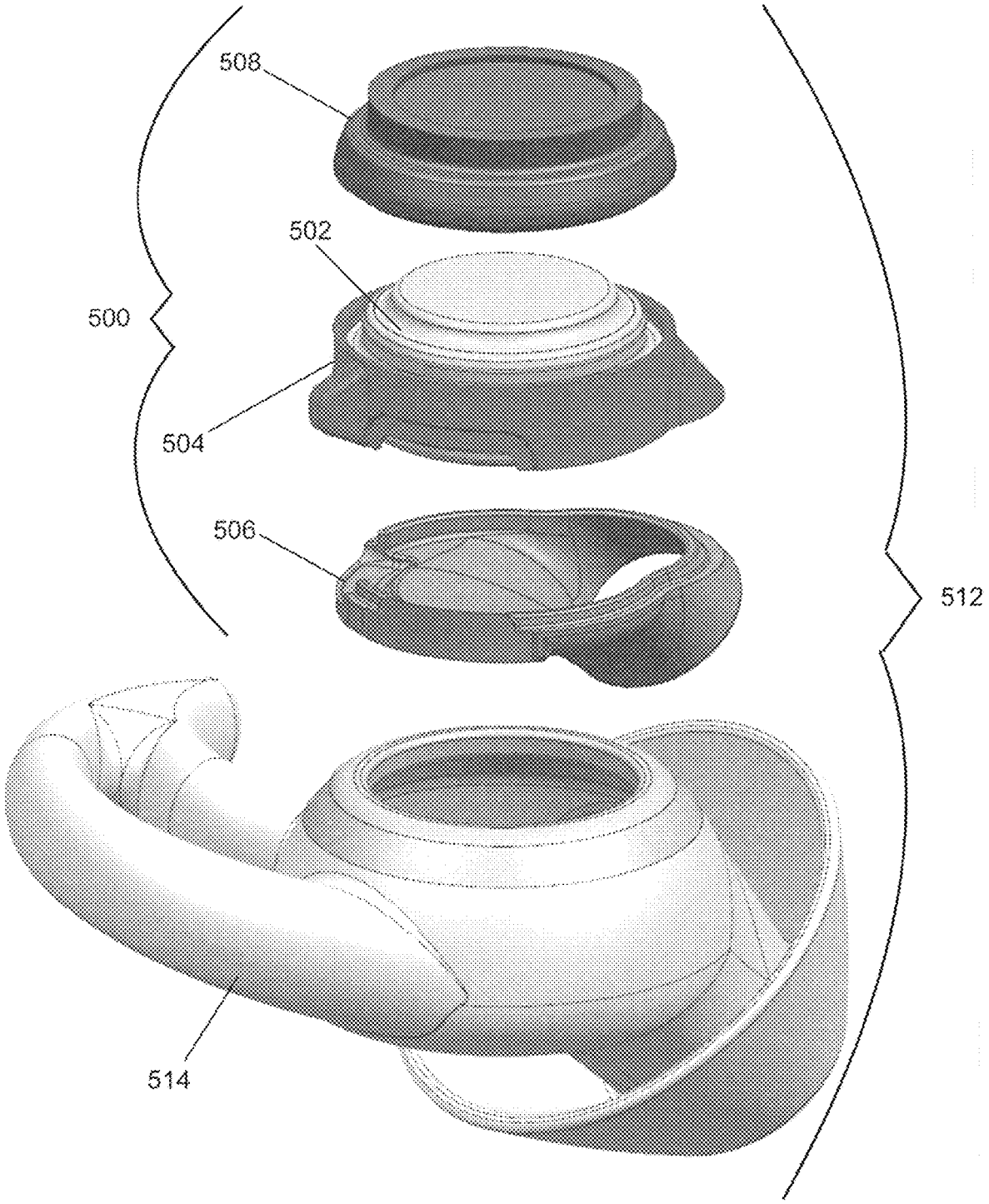
FIG. 5B shows a blown up view of an in-ear earphone having an acoustic driver with a frame integrated with an earbud, and a small ear tip.

In an implementation, an ear tip may surround at least the front cavity enclosure. The ear tip may include a body that rests against the concha, a retaining member comprising one or more legs, an outlet that overlies an outlet of the earbud, and a second port mated to a first port of the earbud. U.S. Pat. No. 9,036,853 describes ear tips and positioning and retaining structures and is incorporated here by reference in its entirety. Referring now to FIG. 5B, a blown-up view of an in-ear earphone 512 having acoustic driver 502 with a frame integrated with earbud 500, and an ear tip 514 are shown. As discussed above, earbud 500 may be comprised of integrated acoustic driver frame 504, front cavity enclosure 506, and back cavity cap 508 which, when joined or molded together, frame acoustic driver 502 and form earbud 500. Ear tip 514 may be made from a pliable material such as silicone and may be stretched to fit around earbud 500 and hold earbud 500 in place when seated in a wearer's ear to form in-ear earphone 512.

Figure 6:
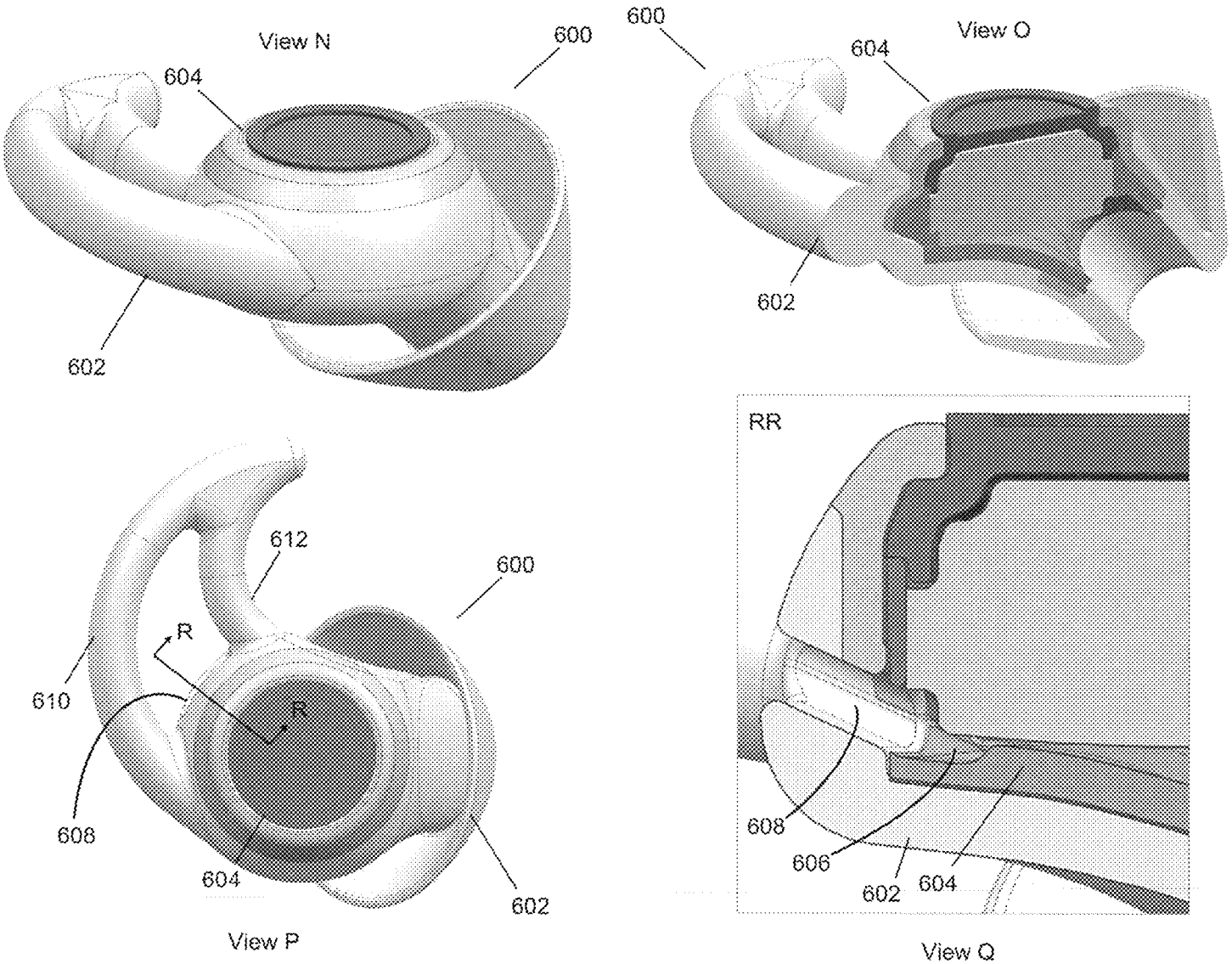
FIG. 6 shows various views of an in-ear earphone having an acoustic driver with a frame integrated with an earbud, and a small ear tip.

Referring now to FIG. 6, various Views N-Q of an in-ear earphone having an ear tip and earbud are shown. In-ear earphone 600 may have ear tip 602 and earbud 604. Ear tip 602 may be a small-sized ear tip and may be made of a pliable material such as silicone that may stretch. As such, earbud 604 may be pushed into ear tip 602 such that earbud 604 sits in ear tip 602 as ear tip 602 stretches around earbud 604 such that earbud 604 is held in place by ear tip 602.

A small-sized ear tip may fit comfortably inside a small concha. A small concha may have physical dimensions less than two standard deviations of mean dimensions exhibited by human conchae. For example, the concha may be roughly described as having a radius, and a small concha or ear tip may fits within a concha having a radius less than two standard deviations of the mean radius for humans. A small ear tip may fit inside larger ears but may not achieve good mechanical stability or acoustic coupling to the ear because the fit may be too loose.

Referring now to View Q of FIG. 6, cross-section RR of in-ear earphone 600 of View P is shown. As shown in View Q, earbud 604 may have port 606. Port 606 may be similar to port 510 of FIG. 5 discussed above. Further, ear tip 602 may have port 608. Ports 606 and 608 may mate to form a pressure equalization port from the acoustic driver of earbud 604 to the outside of ear tip 602.

Figure 7:
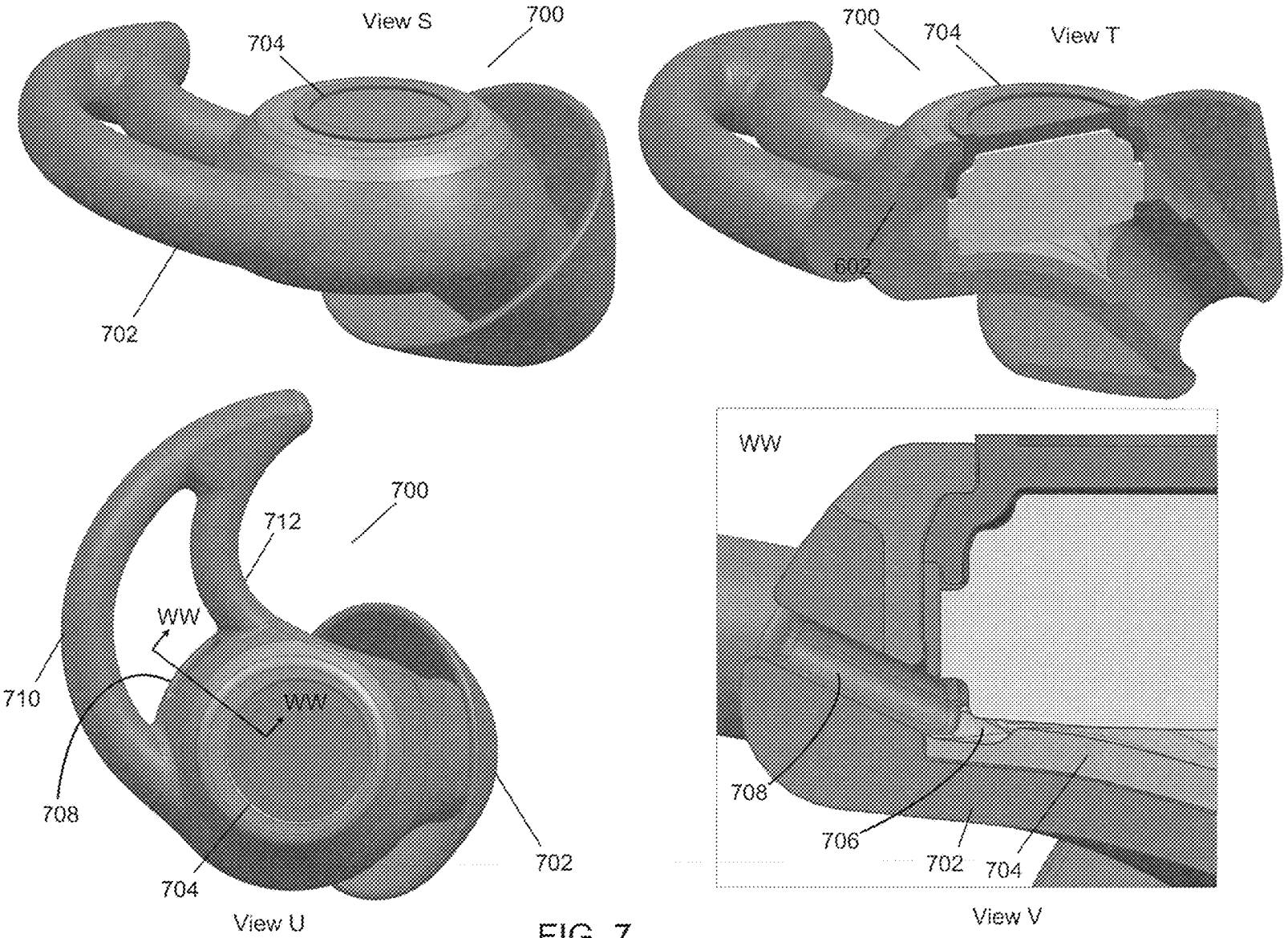
FIG. 7 shows various views of an in-ear earphone having an acoustic driver with a frame integrated with an earbud, and a medium ear tip.

Referring now to FIG. 7, various Views S-V of another in-ear earphone having an ear tip and earbud are shown. In-ear earphone 700 may have ear tip 702 and earbud 704. Ear tip 702 may be a medium-sized ear tip and may also be made of a pliable material such as silicone that may stretch. As such, earbud 704 may be pushed into ear tip 702 such that earbud 704 sits in ear tip 702 as ear tip 702 stretches around earbud 704 such that earbud 704 is held in place by ear tip 702.

A medium ear tip may comfortably fit into most human conchae and may be sized approximately within plus or minus two standard deviations of the mean concha dimensions of humans. A medium ear tip may fit inside a large concha but may not fit inside a small concha.

Referring now to View V of FIG. 7, cross-section WW of in-ear earphone 700 of View U is shown. As shown in View V, earbud 704 may have one or more ports 706. Port 706 may be similar to port 510 of FIG. 5 discussed above. Further, ear tip 702 may have one or more ports 708. Ports 706 and 708 may mate to form a pressure equalization port from the acoustic driver of earbud 704 to the outside of ear tip 702. In an implementation, one or more of the ports described in the present disclosure may form a pressure equalization port from between the front and rear cavities rather than from the acoustic driver to the outside of the ear tip. Additional ports may be included to shape the audio response.

The pressure equalization (PEQ) port may reduce or prevent occlusion created when the ear tip of an in-ear earphone is positioned in an ear. In an implementation, in order for two ports (e.g., ports 606 and 608 or 706 and 708) to form the PEQ port, two notches may need to be created. One notch may be created in the material of the ear tip (e.g., ear tip 602 or 702). Another notch may be created in the earbud (e.g., earbud 604 or 704). For example, a notch may be created in the front cavity enclosure (e.g., front cavity enclosure 506 of FIG. 5) such that the notch creates a hole from the outside of the earbud, reaching the acoustic driver. For example, a hole or notch may be included as part of the molding process for the integrated acoustic driver frame or front cavity enclosure, or may be drilled or ground away from the integrated acoustic driver frame or front cavity enclosure of the earbud.

Ultimately, in an implementation, in order for the hole to reach the outside of the ear tip and reduce the occlusion effect, the hole must extend through the ear tip (e.g., ear tip 602 or 702). This is because, in some situations, the in-ear earphone may seal or partially seal the ear canal even without going into the ear canal beyond the ear canal entrance, when worn by a person. This seal may create the occlusion effect, which may create an uncomfortable sensation of one's own voice. In an implementation, if the ear tip is made from silicone, a hole may be cut-out of the silicone, or the silicone may be formed or molded with the hole. The hole in the integrated acoustic driver frame or front cavity enclosure may be mated with the hole in the silicone when the earbud is positioned in the ear tip, thus preventing the in-ear earphone from sealing the ear canal by allowing pressure to vent through the resulting PEQ port and removing or partially removing the occlusion effect. The PEQ port may also release pressure resulting from movement of the in-ear ear phone while it is positioned in the ear.

Additionally, it may be desirable to allow some of the acoustic energy generated by the acoustic driver to be released and to allow some of acoustic energy from outside the earphone to enter through the PEQ port. This may prevent, for example, in microphone-enabled in-ear earphones, a person from hearing excessive bass or low frequencies from their own voice while talking on the telephone through the microphone and wearing the in-ear earphones, due to the occlusion effect.

In an implementation, a front volume may be created between the acoustic driver and the front cavity enclosure, and a back volume may be created between the acoustic driver and the back cavity cap. The front and back volumes may contain all or most of the acoustic energy created by the acoustic driver. Ports 606, 608, 706, and 708 may be positioned to lower a volume stiffness which may occur at low frequencies. In such a situation, it may be desirable for a diaphragm to move as far as possible. Thus, ports 606, 608, 706, and 708 may be positioned such that at low frequencies, there is an opening to the outside of the in-ear earphone. As frequency increases, the diameter and length is such that it becomes small with respect to wavelength, and it closes, acoustically. At high frequencies, it is a stiff back volume.

Referring back to FIG. 6, in an implementation, ear tip 602 of in-ear earphone 600 may include leg 610, leg 612, and port 608 positioned between legs 610 and 612. Port 608 may mate with port 606 of a front cavity enclosure of earbud 604. As discussed above, ear tip 602 may be a small ear tip and may be formed from a pliable material to surround at least the front cavity enclosure of earbud 604. Referring back to FIG. 7, in an implementation, ear tip 702 of in-ear earphone 700 may include leg 710, leg 712, and port 708 positioned between legs 710 and 712. Port 708 may mate with port 706 of a front cavity enclosure of earbud 704. As discussed above, ear tip 702 may be a medium ear tip and may be formed from a pliable material to surround at least the front cavity enclosure of earbud 704.

Ports 606, 608, 706, and 708 are positioned as described above so that they are not covered when in-ear earphones 600 and 700, respectively, are placed in an ear. In an implementation, port 608 of small ear tip 602 may have a different size than port 708 of medium tip ear tip 702. Ports 608 and 708 may be different lengths in order to allow each port to properly mate to their respective front cavity enclosure ports (e.g., ports 606 and 706) to properly form PEQ ports from the acoustic driver to the outside of the ear tip.

In an implementation, legs 610 and 612 of ear tip 602 and legs 710 and 712 of ear tip 702 may each be part a positioning and retaining structure of ear tips 602 and 702, respectively. The positioning and retaining structure may include the port (e.g., port 608 or 708) positioned to mate with the port a front cavity enclosure (e.g., ports 606 and 706) of an earbud (e.g., earbud 604 or 704). It should be noted that legs 610 and 612 of ear tip 602 and legs 710 and 712 of ear tip 702 are shown for illustrative purposes only and that other positioning and retaining structures for ear tips compatible with earbuds having acoustic drivers with integrated frames and PEQ ports are within the scope of the present disclosure.

The occlusion effect and amount of bass audio received by the wearer of an in-ear ear phone may be related. For example, as occlusion effect is relieved as described above, the wearer may receive less bass audio. In order to achieve an acceptable audio response and acceptable occlusion effect, one or more of resistance, silicone area, and mesh may be adjusted with respect to the PEQ ports described above. As the acoustic driver gets smaller and smaller, the PEQ port may approach 180 degrees of the acoustic driver. This may result in undesirable balance and/or rocking with respect to the acoustic driver. In an implementation, an acoustic mesh or a resistive mesh may be positioned over one or more of ports 606, 608, 706, and 708 in order to tune the desired balance in audio response and occlusion effect.

In an implementation, an in-ear earphone (e.g., in-ear earphone 600 or 700) may include one or more microphones. For example, a microphone may be positioned inside the earbud, outside the earbud, or outside the ear tip and may measure noise in order to cancel it. For example, it may be desirable for noise measured at an inside microphone go to be cancelled to zero. In an implementation, a 4 mm microphone may be positioned on a flexible printed circuit board which may be foldable and in communication with electronic circuitry. The microphone may be positioned to prevent it from contacting earwax, sweat, or other substances which may damage the microphone.

Advantageously, the techniques and features described in the present disclosure may be implemented to save space in an earbud assembly without requiring any changes or significant changes to the design or interior components of the acoustic driver and/or diaphragm itself.

A number of implementations have been described. Nevertheless, it will be understood that additional modifications may be made without departing from the scope of the inventive concepts described herein, and, accordingly, other embodiments are within the scope of the following claims.

What is claimed is:

1. An in-ear earphone comprising:

an earbud assembly comprising:

an acoustic driver having a diaphragm and a magnetic circuit;

an enclosure surrounding the acoustic driver, the enclosure formed by a front cavity enclosure and a back cavity cap, wherein one of the front cavity enclosure and the back cavity cap comprises an integrated acoustic driver frame;

a front cavity formed between the acoustic driver and the front cavity enclosure;

a back cavity formed between the acoustic driver and the back cavity cap; and wherein the integrated acoustic driver frame is directly attached to and surrounds a central perimeter of the acoustic driver with no separate structure surrounding the central perimeter of the acoustic driver.

2. The in-ear earphone of claim 1, wherein the acoustic driver is framed directly by the enclosure.

3. The in-ear earphone of claim 1, wherein the acoustic driver is embedded in the enclosure.

4. The in-ear earphone of claim 1, wherein:

the front cavity enclosure forms an outlet and a first port from the acoustic driver to an outside of the earbud assembly.

5. The in-ear earphone of claim 4, further comprising:

an ear tip surrounding at least the front cavity enclosure.

6. The in-ear earphone of claim 5, wherein the ear tip has a second port mated to the first port to form a pressure equalization port from the acoustic driver to an outside of the ear tip.

7. The in-ear earphone of claim 4, further comprising:

a resistive mesh positioned over the first port.

8. The in-ear earphone of claim 1, further comprising:

a microphone.

9. The in-ear earphone of claim 1, wherein the integrated acoustic driver frame maximizes a size of the diaphragm of the acoustic driver relative to a size of the earbud assembly.

10. The in-ear earphone of claim 6, wherein the second port of the ear tip has a different length for a small tip ear tip than a medium tip ear tip.

11. An earbud assembly comprising:

an acoustic driver having a diaphragm and a magnetic circuit wherein a frame of the acoustic driver is integrated with the earbud assembly, the integrated acoustic driver frame forming an enclosure surrounding the acoustic driver with one of a back cavity cap and a front cavity enclosure comprising the integrated acoustic driver frame, wherein the acoustic driver sits directly in the enclosure, and is framed directly by the enclosure, and the integrated acoustic driver frame is directly attached to and surrounds a central perimeter of the acoustic driver with no separate structure surrounding the central perimeter of the acoustic driver.

12. The earbud of claim 11, wherein the acoustic driver is embedded in the earbud assembly.

13. The earbud of claim 11, wherein:

the front cavity enclosure forms an outlet and a port from the acoustic driver to an outside of the earbud.

14. The earbud of claim 13, wherein the port is a pressure equalization port from the acoustic driver to the outside of the earbud.

15. The earbud of claim 13, further comprising:

a resistive mesh positioned over the port.

16. The earbud of claim 13, further comprising:

a microphone.

17. The earbud of claim 11, wherein the integrated acoustic driver frame maximizes a size of the diaphragm of the acoustic driver relative to a size of the earbud assembly.

18. An ear tip for an in-ear earphone formed from a pliable material to surround at least a front cavity enclosure of an earbud assembly wherein the earbud assembly comprises an acoustic driver having a diaphragm and a magnetic circuit, and wherein an enclosure surrounding the acoustic driver is formed by a front cavity enclosure and a back cavity cap, wherein one of the front cavity enclosure and the back cavity cap comprises an integrated acoustic driver frame directly attached to and surrounding a central perimeter of the acoustic driver with no separate structure surrounding the central perimeter of the acoustic driver.

19. The ear tip of claim 18, further comprising:

a first leg, a second leg, and a first port positioned between the first leg and the second leg to mate with a second port of the front cavity enclosure of the earbud assembly.

20. The ear tip of claim 19, wherein the first port of the ear tip has a different length for a small tip ear tip than a medium tip ear tip.

21. The ear tip of claim 19, wherein the first port and the second port mate to form a pressure equalization port from the acoustic driver to an outside of the ear tip.

22. The in-ear earphone of claim 1, wherein the earbud assembly itself is a structure holding the diaphragm and the magnetic circuit in place and eliminates a need for a separate structure between the enclosure and the enclosure.

23. The in-ear earphone of claim 1, wherein there is no intervening structure between the acoustic driver and the enclosure.

24. The in-ear earphone of claim 1, wherein the integrated acoustic driver frame reduces a diameter of the earbud assembly by about 1-2 millimeters.

25. The in-ear earphone of claim 23, wherein the enclosure is a housing of the acoustic driver and the acoustic driver has no separate housing from the enclosure.

26. The ear tip for the in-ear earphone of claim 18, wherein the enclosure is the only structure directly supporting the acoustic driver and the ear tip is separate from the enclosure.

* * * * *